United States Patent [19]

Lu et al.

[11] 4,411,974

[45] Oct. 25, 1983

[54] ORTHO-HALO PHENYL CARBOXYLIC ACID CHARGE ENHANCING ADDITIVES

[75] Inventors: Chin H. Lu, Webster; Christopher J. Au Clair, Fairport; Peter F. Erhardt, Webster, all of N.Y.

[73] Assignee: Xerox Corporation, Stamford, Conn.

[21] Appl. No.: 367,193

[22] Filed: Apr. 12, 1982

[51] Int. Cl.[3] ..... G03G 9/08

[52] U.S. Cl. ..... 430/106; 430/110; 430/120; 430/126

[58] Field of Search ..... 430/97, 108, 110, 137, 430/106, 120, 126

[56] References Cited

U.S. PATENT DOCUMENTS

| | | | |
|---|---|---|---|
| 3,609,082 | 9/1971 | Moriconi et al. | 252/62.1 |
| 3,884,825 | 5/1975 | Lindblad et al. | 252/62.1 |
| 3,893,935 | 7/1975 | Jadwin et al. | 252/62.1 |
| 4,073,739 | 2/1978 | Peters | 252/62.1 P |
| 4,139,483 | 2/1979 | Williams et al. | 430/110 |
| 4,248,954 | 2/1981 | Datta et al. | 430/110 |
| 4,298,672 | 11/1981 | Lu | 430/108 |

*Primary Examiner*—John E. Kittle
*Assistant Examiner*—John L. Goodrow
*Attorney, Agent, or Firm*—E. O. Palazzo

[57] ABSTRACT

This invention is directed to negatively charged toner compositions, and developer compositions, the toner composition being comprised of resin particles, and pigment particles, and from about 0.1 to about 10 percent based on the weight of the resin particles, a ortho-halo pheny carboxylic acid charge enhancing additive of the formula:

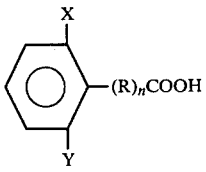

wherein X is halogen, Y is hydrogen or halogen, and R is an alkylene group of from 1 to about 3 carbon atoms, and n is the number zero (O) or 1; as well as to methods of utilizing such compositions in electrostatographic imaging systems, particularly those systems wherein colored images are produced.

33 Claims, No Drawings

ORTHO-HALO PHENYL CARBOXYLIC ACID CHARGE ENHANCING ADDITIVES

BACKGROUND OF THE INVENTION

This invention is generally directed to new toner compositions, and developer compositions containing certain charge enhancing additives. More specifically, the present invention is directed to developer compositions containing toner particles, and ortho-halo phenyl carboxylic acids as charge enhancing additives, which additives impart a negative charge to the toner resin particles. Developer compositions containing such charge enhancing additives are useful for causing the development of electrostatic latent images, including color images. Furthermore, the developer compositions of the present invention can be employed with common carrier particles of the same composition as compared to some prior art developer compositions wherein carrier particles of different compositions are needed, when such compositions are used to develop color electrostatic images.

Developer compositions containing charge enhancing additives are known in the prior art, particularly, those developers containing charge enhancing additives which impart a positive charge to the toner resin. However, very few developing compositions are known in the art wherein charge enhancing additives are emplofyed for the purpose of imparting a negative charge to the toner resin. Examples of positively charged toner compositions include those described in U.S. Pat. No. 3,893,935, wherein there is disclosed the use of certain quaternary ammonium compounds as charge control agents for electrostatic toner compositions. This patent states that certain quaternary ammonium compounds when incorporated into toner materials were found to provide a toner composition which exhibited a relatively high uniform and stable net toner charge when mixed with a suitable carrier particle. A similar teaching is described in U.S. Pat. No. 4,079,014 with the exception that a different charge control additive is employed, namely, a diazo compound. Other charge enhancing additives are described, for example, in U.S. Pat. No. 4,298,672, wherein there is disclosed developer compositions containing as charge enhancing additives certain alkyl pyridinium halides, particularly cetyl pyridinium chloride for the purpose of imparting a positive charge to the toner resin.

In some instances, it may be desirable in electrostatographic imaging systems to produce a reverse copy of the original. Thus, for example, it may be desired to produce a negative copy from a positive original or positive copy from a negative original. This is generally referred to in the art as image reversal, which in electrostatic printing systems can be accomplished by applying to the image a developer powder which is repelled by the charged areas of the image, and adheres to the discharged areas. More specifically, for example, toner particles possessing positive charges are found to be very useful and effective in electrostatographic reversal systems, and in particular in xerographic systems employing organic photoreceptors, which in many instances are charged negatively rather than positively, thus necessitating the need for positively charged toner compositions.

In contrast, the present invention is concerned with negatively charged toner particles, that is, where the toner particles possess a negative charge rather than a positive charge, the negative charge being imparted by the charge enhancing additives of the present invention to be described hereinafter. Further, the charge enhancing additives of the present invention possess other desirable properties in that, for example, they are capable of imparting substantially similar triboelectric charges to all toner compositions irrespective of color. Also the toner compositions of the present invention can be incorporated into developer compositions containing common carrier particles.

SUMMARY OF THE INVENTION

It is an object of the present invention to provide toner compositions and developer compositions which overcome the above-ndoted disadvantages.

Another object of the present invention is the provision of negatively charged toner compositions, which are useful for causing the development of electrostatic latent images, including color images.

In yet another object of the present invention, there is provided negatively charged toner compositions containing as charge enhancing additives certain ortho-halo phenyl carboxylic acids.

In yet another object of the present invention, there are provided color developer compositions comprised of toner particles, common carrier particles of the same composition, and an ortho-halo phenyl carboxylic acid charge enhancing additive, for the purpose of imparting a negative charge to the toner resin.

These and other objects of the present invention are accomplished by the provision of an electrostatic toner composition, and developer compositions thereof, wherein the toner composition is comprised of resin particles, colorant and/or pigment particles, and an ortho-halo phenyl carboxylic acid charge enhancing additive of the formula:

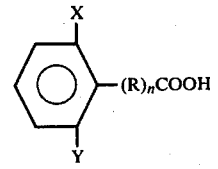

wherein X is halogen, Y is hydrogen or halogen, R is an alkylene radical containing from about 1 to about 3 carbon atoms, and n is the number zero (0) or 1. Examples of halogen materials for X include fluoride, chloride or bromide, with fluoride being preferred, while examples of alkylene groups include methylene, ethylene, propylene and the like. It is important to the present invention that the halogen groups be in the 2 and 6 positions, or ortho positions, relative to the carboxylic acid group or substituted carboxylic acid, as should the halogen groups be in the 3 or 5 position, that is the meta position, or in the 4 position, the para position, negative polarity enhancement can be adversely affected, and in many instances, such polarity will not be achieved.

While it is not desired to be limited by theory, it is believed that the ortho halogen substituent influences the activity of the carboxylic acid group by intramolecular electron displacement. Furthermore, halides such as the fluoride atom are strongly electronegative, and have the effect of depleting the electron density from the mobile pie bond system of the aromatic ring; and the carboxylic acid group is a well known electronic acceptor which in the absence of other substituents withdraws electrons from the ring systems and activates the ortho and para positions. The adjacent proximity of two such electron withdrawing groups is believed to be responsible for the negative charge activating nature of, for example, ortho-fluoro benzoic acid.

Illustrative examples of ortho-halo phenyl carboxylic acids embraced within the scope of the present invention include 2-fluoro benzoic acid, 2,6-difluoro benzoic acid, 2-fluoro-6-chloro benzoic acid, 2-fluoro-phenyl acetic acid, 2-fluoro-6-chloro phenyl acetic acid, 2-fluoro phenyl propionic acid, 2-fluoro-6-chloro phenyl propionic acid, and the salts thereof such as the sodium, potassium, and calcium salts, and the like.

The ortho-halo phenyl carboxylic acid charge enhancing additives of the present invention can be employed in toner compositions, and developer compositions in various amounts, provided they do not adversely affect such materials, and result in a toner that is negatively charged in comparison to the carrier particles. Thus, for example, the amount of ortho-halo phenyl carboxylic acid employed ranges from about 0.1 percent by weight to about 10 percent by weight of toner particles, and preferably is from about 0.5 percent by weight to about 5 percent by weight of the toner particles. In one preferred embodiment, the ortho-halo phenyl carboxylic acid charge enhancing additive of the present invention is present in an amount of from about 1 weight percent to about 3 weight percent.

The charge enhancing additive of the present invention can either be blended into the toner composition or coated on the colorant or pigment, such as carbon black, cyan material, magenta material or yellow material, which is selected as the colorant or pigment for the developer composition. When it is employed as a coating, the charge enhancing additive of the present invention is present in an amount of from about 2 weight percent to about 20 weight percent, and preferably from about 5 weight percent to about 10 weight percent.

Various methods can be employed for producing the toner and developer compositions of the present invention, one method involving melt blending the resin particles and pigment particles coated with the ortho-halo phenyl carboxylic acid charge enhancing additive of the present invention, followed by mechanical attrition. Other methods include those well known in the art such as spray drying, melt dispersion, dispersion polymerization and suspension polymerization. in dispersion polymerization a solvent dispersant of resin particles, pigment particles and the ortho-halo phenyl carboxylic acid charge enhancing additive of the present invention are spray dried under controlled conditions resulting in the desired product. A toner prepared in this manner results in a negatively charged toner in relationship to the carrier materials present in the developer composition; and these compositions exhibit the improved properties as mentioned hereinbefore. Other methods of preparation can be utilized; providing the objectives of the present invention are achieved.

Various suitable resins can be utilized with the charge enhancing additives of the present invention. Typical resins include, for example, thermoplastic materials, such as polyamides, epoxies, polyurethanes, vinyl resins, and polyesters, especially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of aliphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing relatively high percentages of styrene are preferred. The styrene resin employed may be a homopolymer of styrene, or of styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which insure good triboelectric properties and unifirom resistance against physical degradation. However, non-vinyl type thermoplastic resins may also be employed including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred resin material for the toner composition of the present invention. These materials are illustrated in U.S. Pat. No. 3,655,374, the disclosure of which is totally incorporated herein by reference, the diphenol reactant being of the formula as shown in Column 4, beginning at line 5, of this patent, and the dicarboxylic acid being of the formula as shown in Column 6.

The resin particles are present in an amount that provides a total of about 100 percent for all toner ingredients, thus when 5 percent by weight of the charge enhancing composition of the present invention is present, and 10 percent by weight of pigment or colorant particles such as carbon black are present, about 85 percent by weight of resin material is incorporated into the toner composition.

With regard to developer compositions utilized for the development of electrostatic latent images wherein there results a black image, various suitable pigments or dyes can be utilized as the colorant for the toner particles, such materials being well known, and including, for example, carbon black, magnetite, iron oxides, nigrosine dye, chrome yellow, ultramarine blue, duPont oil red, methylene blue chloride, phthalocyanine blue and mixtures thereof. The pigment or dye should be present in the toner in sufficient quantity to render it highly colored, thus allowing the toner composition to create a clearly visible image on the recording member. Thus, for example, when conventional xerographic copies of documents are desired, the toner may comprise a black pigment, such as carbon black, or a black dye such as Amaplast black dye available from the National Aniline Products, Inc. Preferably the pigment is employed in amounts of from about 3 percent to about 50 percent by weight based on the total weight of the toner particles, however, if the pigment employed is a dye, substantially smaller quantities, for example less than 10 percent by weight, may be used.

With regard to developer compositions utilized for obtaining color images, there is employed as the colorant or pigment particles such as those containing cyan pigments, magenta pigments, yellow pigments, and mixtures thereof. Illustrative examples of cyan pigments include copper tetra-4-(octadecylsulfonomido)phthalocyanine, the X-copper phthalocyanine pigment listed in the color index as CI 74160, CI Pigment Blue 15, an Anthradanthrene blue identified in the color index as CI 61890, Special Blue X-2137 and the like; while illustrative examples of yellow pigments that may be selected include diarylide yellow 3,3-dichloro benzidene acetoacetanilide a monoazo pigment identified in the color index as CI 12700, CI Solvent Yellow 16, a nitrophenyl amine sulfonamide identified in the color index as Foron Yellow SE/GLF, CI Dispersed Yellow 33, 2,5-dimethoxy-4-sulfonoanilide phenylazo-4-chloro-2,5-dimethoxy acetoacetanilide, permanent yellow FGL, and the like. Illustrative examples of magenta materials that may be selected as pigments, include for example, 2,9-dimethyl substituted quinacridone and anthraquinone dye identified in the color index as CI 60710, CI Dispersed Red 15, a diazo dye identified in the color index as CI 26050, CI Solvent Red 19, and the like.

The cyan, magenta and yellow pigments, when utilized with the charge enhancing additives of the present invention are generally incorporated into the tone composition in an amount of from about 2 weight percent to about 30 weight percent and preferably from about 5 weight percent to about 15 weight percent, based on the weight of the toner particles.

Various suitable carrier particles can be incorporated into the developer composition of the present invention, providing that the toner particles are charged negatively in comparison to the carrier particles. Thus, the carrier particles are selected so as to acquire a charge of a positive polarity, and include materials such as steel, nickel, iron ferrites, silicon dioxide and the like. The carrier particles may contain a coating such as polymers of styrene, methyl methacrylate, and silanes. Many of the typical carriers that can be used are described in U.S. Pat. No. 2,638,522. Also nickel berry carriers as described in U.S. Pat. Nos. 3,847,604 and 3,767,598 can be employed, these carriers being nodular carrier beads of nickel characterized by surfaces of reoccurring recesses and protrusions, thus providing particles with a relatively large external area. The diameter of the coated carrier particle is from about 50 to about 1,000 microns, thus allowing the carrier to possess sufficient density and inertia to avoid adherence to the electrostatic images during the development process.

The carrier particles may be mixed with the toner composition in various suitable combinations, however, best results are obtained when about 1 part of toner particles to about 10 to about 200 parts by weight of carrier particles are utilized.

The toner and developer compositions of the present invention may be used to develop electrostatic latent images, including color images, on various suitable imaging surfaces, capable of retaining charge including, for example, conventional photoreceptor surfaces known in the art, such as inorganic photoconductors, like selenium, and layered photoresponsive devices wherein a positive charge resides on the photoresponsive surface, which method comprises contacting the electrostatic latent image with the developer composition of the present invention, followed by transferring the resulting image to a suitable substrate, and optionally permanently affixing the image by, for example, heat. In addition to selenium, illustrative examples of useful inorganic photoreceptors include halogen doped amorphous selenium, alloys of amorphous selenium, such as arsenic selenium, selenium tellurium, and the like. halogen doped selenium alloys, cadmium sulfide, zinc oxide, and the like. Amorphous selenium and a selenium arsenic alloy containing about 99.95 percent selenium and 0.5 percent arsenic are preferred. Color images can be obtained using, for example, a single pass process as described in U.S. Pat. No. 4,312,932 the disclosure of which is totally incorporated herein by reference.

The following examples are being supplied to further define certain embodiments of the present invention, it being noted that these examples are intended to be illustrative only, and are not intended to limit the scope of the present invention. Parts and percentages are by weight unless otherwise indicated.

EXAMPLE I

The following four (4) green toner compositions were prepared by melt blending followed by mechanical attrition. Control toner composition A contained 4 percent of the yellow pigment 2,5-dimethoxy-4-sulfonanilide phenylazo-4'-chloro-2,5-dimethoxy acetoacetanilide, permanent yellow FGL, 2 percent of the cyan pigment, copper tetra-4(octadecylsulfonomido)phthalocyanine, and 94 percent of a styrene/n-butyl methacrylate (58/42) copolymer resin.

Toner composition B contained 4 percent of the yellow pigment of toner composition A, 2 percent of the cyan pigment of toner composition A, 92 percent by weight of a styrene/n-butylmethacrylate copolymer resin, (58/42) and 2 percent by weight of orthofluorobenzoic acid (OFBA). Toner composition C was comprised of the same components, and in the same amounts as toner composition B, with the exception that toner composition C contained 2 percent by weight of para-fluorobenzoic acid (PFBA) in place of the orthofluorobenzoic acid. Toner composition M contained the same components, and in the same amounts as toner composition B, with the exception that toner composition M contained 2 percent by weight of meta-fluoro benzoic acid (MFBA) in place of the ortho-fluoro benzoic acid.

The triboelectric properties of these toner compositions were measured using a Faraday cage, against ferrite carrier particles consisting of a ferrite core coated with 0.5 percent of a methyl methacrylate terpolymer, reference U.S. Pat. No. 3,526,533, at a 2 percent by weight toner concentration with the following results:

| Toner | Charge Control Additive % | Toner Tribo Microcoulombs per gram (uc/g) 10min | 60min | 180min | 300min |
|---|---|---|---|---|---|
| A (control) | 0 | −11 | −6 | −5 | −4 |
| B | 2% (OFBA) | −19 | −28 | −33 | −33 |
| C | 2% (PFBA) | +5 | +24 | +33 | +38 |
| M | 2% (MFBA) | −3 | −1 | −1 | −1 |

Toner composition B which contained ortho-fluoro benzoic acid as a charge enhancing additive had a higher negative toner triboelectric charge value than toner A (control) which contained no charge control agent. Toner composition C which contained para-fluoro benzoic acid charged positively, and toner composition M which contained meta-fluoro benzoic acid had considerably lower triboelectric charge values than toner composition B, indicating that the position of the halogen group relative to the carboxylic group was crucial.

EXAMPLE II

Four (4) red toner compositions were prepared in accordance with Example I, by melt blending followed by mechanical attrition. Control toner composition D contained 1.67 percent of the magenta pigment 2,9-dimethylquinacridone, and 3.33 percent of the yellow pigment of Example I, and 95 percent of a styrene/n-butyl methacrylate resin (58/42). Toner compositions E, F, and G contained in addition to the components of toner composition D, 1, 2 and 3 percent of ortho-fluorobenzoic acid. These compositions were then classified to remove particles below 5 microns. Triboelectric charge measurements were then accomplished for toner compositions D, E, F and G in accordance with Example I, utilizing the same carrier particles, with the following results:

| Toner | Charge Control Additive % | Toner Tribo Microcoulombs per gram (uc/g) 10min | 60min | 180min | 300min |
|---|---|---|---|---|---|
| D (control) | 0 | −8 | −13 | −16 | −12 |
| E | 1% (OFBA) | −10 | −24 | −35 | −29 |
| F | 2% (OFBA) | −10 | −21 | −34 | −34 |
| G | 3% (OFBA) | −10 | −20 | −31 | −26 |

Toners E, F and G which contained OFBA as a charge enhancing additive had significantly higher negative triboelectric values than control toner composition D.

EXAMPLE III

Four (4) brown toner compositions were prepared in accordance with Example I by melt blending followed by mechanical attrition. Control toner composition H contained 0.39 percent of the cyan pigment, of Example I, 3.46 percent of the yellow pigment of Example I, 1.10 percent of the magenta pigment of Example II, and 95 percent of a styrene/n-butyl methacrylate copolymer resin (58/42). Toner compositions J, K and L contained, in addition to the components incorporated in toner composition H, 1, 2 and 3 percent by weight of ortho-fluoro benzoic acid. The toner compositions were then classified to remove particles below 5 microns and the toner triboelectric values were measured in accordance with Example I, with the following results:

| Toner | Charge Control Additive % | Toner Tribo Microcoulombs per gram (uc/g) 10min | 60min | 180min | 300min |
|---|---|---|---|---|---|
| H (Control) | 0 | −11 | −17 | −20 | −19 |
| J | 1% (OFBA) | −15 | −25 | −33 | −30 |
| K | 2% (OFBA) | −15 | −30 | −32 | −34 |
| L | 3% (OFBA) | −13 | −28 | −38 | −38 |

EXAMPLE IV

Toner compositions B, F and K, prepared above, were then compared for their triboelectric charging values by formulating a table as follows:

| Toner | Color | Charge Control Additive % | Toner Tribo Microcoulombs per gram (uc/g) 10min | 60min | 180min | 300min |
|---|---|---|---|---|---|---|
| B | green | 2% (OFBA) | −18 | −28 | −33 | −33 |
| F | red | 2% (OFBA) | −10 | −21 | −34 | −34 |
| K | brown | 2% (OFBA) | −15 | −30 | −32 | −34 |

Reference to the above Table indicates that the three toner compositions regardless of their color, that is green, red or brown, had substantially similar triboelectric charging values for 10 minutes, 60 minutes, 180 minutes, and 300 minutes, against the same carrier composition (a carrier consisting of a ferrite core coated with a methyl terpolymer, reference Example I) demonstrating that a carrier composition comprised of the same ingredients could be used for different color developing compositions.

EXAMPLE V

Toner composition N was prepared in accordance with Example I, and contained 4 percent by weight of the yellow pigment of Example I, 2 percent by weight of the cyan pigment of Example I, 2 percent by weight of 2-fluoro-6-chloro benzoic acid (FCBA) as a charge enhancing additive, and 92 percent by weight of a styrene/n-butyl methacrylate copolymer resin (58/42). The toner composition was then further classified to remove particles smaller than 5 microns. The triboelectric charging values of the toner was then determined in accordance with Example I, and these values were compared with control toner composition A, with the following results:

| Toner | Charge Additive % | Toner Tribo Microcoulombs per gram (uc/g) 10min | 60min | 180min | 300min |
|---|---|---|---|---|---|
| A (control) | 0 | −11 | −6 | −5 | −4 |
| N | 2% (FCBA) | −12 | −14 | −15 | −16 |

EXAMPLE VI

Developer compositions were prepared by mixing together 1 part by weight of the toner compositions of Examples I, II, III and V, containing the charge enhancing additives specified, with 100 parts by weight of carrier particles consisting of a ferrite core coated with 0.5 percent of a methyl methacrylate, styrene, silane terpolymer, reference U.S. Pat. No. 3,526,533.

The resulting developer compositions were then utilized to develop latent electrostatic images formed on an amorphous selenium photoreceptor device charged positively, and there resulted color copies of excellent quality utilizing a single pass xerographic color imaging process.

Other modifications of the present invention may occur to those skilled in the art based upon a reading of the present disclosure, and these are intended to be included within the scope of the present invention.

We claim:

1. A dry negatively charged toner composition comprised of resin particles, and pigment particles, and from about 0.1 to about 10 weight percent of an ortho-halo phenyl carboxylic acid charge enhancing additive of the formula:

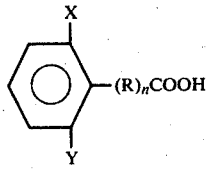

wherein X is halogen, Y is hydrogen or halogen, R is an alkylene group of from 1 to about 3 carbon atoms, and n is the number zero (0) or 1.

2. A toner composition in accordance with claim 1 wherein X is fluoride, chloride, or bromide.

3. A toner composition in accordance with claim 1 wherein Y is fluoride, chloride or bromide.

4. A toner composition in accordance with claim 1 wherein X and Y are halogen, and R is methylene.

5. A toner composition in accordance with claim 1 wherein n is zero.

6. A toner composition in accordance with claim 1 wherein the charge enhancing additive is ortho-fluoro benzoic acid.

7. A toner composition in accordance with claim 1 wherein the charge enhancing additive is 2,6-difluoro benzoic acid.

8. A toner composition in accordance with claim 1 wherein the charge enhancing additive is 2-fluoro-6-chloro benzoic acid.

9. A toner composition in accordance with claim 1 wherein the charge enhancing additive is 2-fluoro phenyl acetic acid, 2-fluoro-6-chloro phenyl acetic acid, 2-fluoro phenyl propionic acid, or 2-fluoro-6-chloro phenyl propionic acid.

10. A toner composition in accordance with claim 1 wherein the resin is a styrene/n-butyl methacrylate copolymer resin.

11. A toner composition in accordance with claim 1 wherein the pigment particles are carbon black, cyan, magenta, yellow or mixtures thereof.

12. A developer composition comprised carrier particles, and negatively charged toner particles, comprised of resin particles and pigment particles, and from about 0.1 percent by weight to about 10 percent by weight of an ortho-halo phenyl carboxylic acid of the formula:

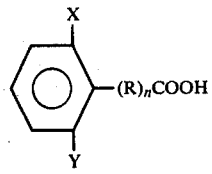

wherein X is halogen, Y is hydrogen or halogen, R is an alkylene group of from 1 to about 3 carbon atoms, and n is the number zero (0) or 1.

13. A developer composition in accordance with claim 12 wherein X and Y are halogen selected from fluoride, bromide and chloride, and R is methylene.

14. A developer composition in accordance with claim 12 wherein n is zero.

15. A developer composition in accordance with claim 12 wherein the charge enhancing additive is ortho-fluoro benozic acid.

16. A developer composition in accordance with claim 12 wherein the charge enhancing additive is 2,6-difluoro benzoic acid.

17. A developer composition in accordance with claim 12 wherein the charge enhancing additive is 2-fluoro-6-chloro benzoic acid.

18. A developer composition in accordance with claim 12 wherein the charge enhancing additive is 2-fluoro phenyl acetic acid, 2-fluoro-6-chloro phenyl acetic acid, 2-fluoro phenyl propionic acid, or 2 fluoro-6-chloro phenyl propionic acid.

19. A developer composition in accordance with claim 12 wherein the resin is a styrene/n-butyl methacrylate copolymer resin.

20. A developer composition in accordance with claim 12 wherein the carrier particles consist of a steel core coated with a terpolymer of styrene, methyl methacrylate, and a silane.

21. A developer composition in accordance with claim 12 wherein the pigment is carbon black.

22. A developer composition in accordance with claim 12 wherein the pigment particles are comprised of a material selected from cyan, magenta and yellow pigments, or mixtures thereof.

23. A developer composition in accordance with claim 22 wherein the cyan pigment is copper tetra-4(octadecylsulfonomido)phthalocyanine.

24. A developer composition in accordance with claim 22 wherein the magenta pigment is 2,9-dimethylquinacridone.

25. A developer composition in accordance with claim 22 wherein the yellow pigment is 2,5-dimethoxy-4-sulfonoanilide phenylazo-4'-chloro-2,5-dimethoxy aceto-acetanilide.

26. A method for developing electrostatic latent images comprising forming a positive electrostatic latent image on an inorganic photoresponsive device, contacting the resulting image with the toner composition of claim 1, followed by transferring the image to a suitable substrate and optionally, permanently affixing the image thereto.

27. A method of imaging in accordance with claim 26 wherein the pigment particles are comprised of cyan, magenta, and yellow pigments, or mixtures thereof, and there results color images.

28. A method of imaging in accordance with claim 27 wherein the ortho-halo phenyl carboxylic acid is ortho-fluoro benzoic acid.

29. A method of imaging in accordance with claim 26 wherein the carrier particles consist of a steel core coated with a terpolymer of styrene, methyl methacrylate, and a silane.

30. A method of imaging in accordance with claim 26 wherein the resin particles are comprised of a styrene/n-butylmethacrylate copolymer resin.

31. An improved colored developer composition comprised of negatively charged toner particles, and carrier particles, wherein the toner particles are comprised of resin particles, pigment particles selected from cyan, magenta, yellow, or mixtures thereof, and from about 0.1 percent by weight to about 10 percent by weight of 2-fluoro benzoic acid, 2,6-difluoro benzoic acid, 2-fluoro-6-chloro benzoic acid, 2-fluoro phenyl acetic acid, 2-fluoro-6-chloro phenyl acetic acid, 2-fluoro phenyl propionic acid, or 2-fluoro-6-chloro phenyl propionic acid.

32. An improved developer composition in accordance with claim 31 wherein the resin particles are comprised of a styrene/n-butylmethacrylate copolymer, the yellow pigment is 2,5-dimethoxy-4-sulfonoanilide phenylazo-4'-chloro-2,5-dimethoxy aceto-acetanilide, the cyan pigment is copper tetra-4(octadecylsulfonomido)phthalocyanine, and the charge enhancing additive is 2-fluoro benzoic acid.

33. An improved developer composition in accordance with claim 31 wherein the magenta pigment is 2,9-dimethylquinacridone, the yellow pigment is 2,5-dimethoxy-4-sulfonoanilide phenylazo-4'-chloro-2,5-dimethoxy aceto-acetanilide, and the charge enhancing additive is 2-fluoro benzoic acid.

* * * * *